US005763993A

United States Patent [19]

Park et al.

[11] Patent Number: 5,763,993

[45] Date of Patent: Jun. 9, 1998

[54] FOCUSING ELECTRODE STRUCTURE FOR A COLOR CATHODE RAY TUBE

[75] Inventors: In-kyu Park, Kwunsun-ku; Myung-hwan Lee, Kyunggi-do; Duk-ho Kim, Baldai-ku, all of Rep. of Korea

[73] Assignee: Samsung Display Devices Co., Ltd., Kyunggi-do, Rep. of Korea

[21] Appl. No.: 654,664

[22] Filed: May 28, 1996

Related U.S. Application Data

[63] Continuation-in-part of Ser. No. 319,457, Oct. 5, 1994, abandoned.

[30] Foreign Application Priority Data

Apr. 1, 1994 [KR] Rep. of Korea ..... 94-6924

[51] Int. Cl.[6] ..... H01J 29/51

[52] U.S. Cl. ..... 313/414; 313/412

[58] Field of Search ..... 313/412, 414, 313/460; 315/368.11

[56] References Cited

U.S. PATENT DOCUMENTS

| | | | |
|---|---|---|---|
| Re. 34,339 | 8/1993 | Osakabe | 315/382 |
| 4,374,342 | 2/1983 | Say | 313/414 |
| 4,886,999 | 12/1989 | Yamane et al. | 313/414 |
| 5,017,843 | 5/1991 | Barten | 315/368.11 |
| 5,091,673 | 2/1992 | Shimoma et al. | 313/412 |
| 5,262,702 | 11/1993 | Shimoma et al. | 315/382 |
| 5,285,130 | 2/1994 | Takayama | 313/414 |
| 5,300,855 | 4/1994 | Kweon | 313/414 |

FOREIGN PATENT DOCUMENTS

| | | | |
|---|---|---|---|
| 906172 | 8/1990 | Rep. of Korea | H01J 29/50 |
| 923357 | 4/1992 | Rep. of Korea | H01J 29/50 |

*Primary Examiner*—Sandra L. O'Shea
*Assistant Examiner*—Michael Day
*Attorney, Agent, or Firm*—Christie, Parker & Hale, LLP

[57] ABSTRACT

An electron gun for a color cathode ray tube is formed with a control electrode, an accelerating electrode, an anode, and a focusing electrode divided into a first and a second focusing electrode. A static focusing voltage predetermined independently of a deflection period is applied to the first focusing electrode and a parabolic waveform dynamic focusing voltage varying according to the deflection period is applied to the second focusing electrode. The first focusing electrode has three electron beam apertures with vertical parallel plates mounted around each aperture in a direction opposite to the direction of the electron beams. The second focusing electrode has three electron beam apertures with horizontal parallel plates mounted around each aperture in a direction opposite to the direction of the electron beams. The centers of the left and right electron beam apertures are offset to the left and right sides of the central axis of the vertical and horizontal parallel plates. This configuration allows easy assembly and produces a vertical elongated electron beam even with low dynamic voltage $V_d$ and thereby improves the focus of the electron beam.

13 Claims, 6 Drawing Sheets

FIG. 5A
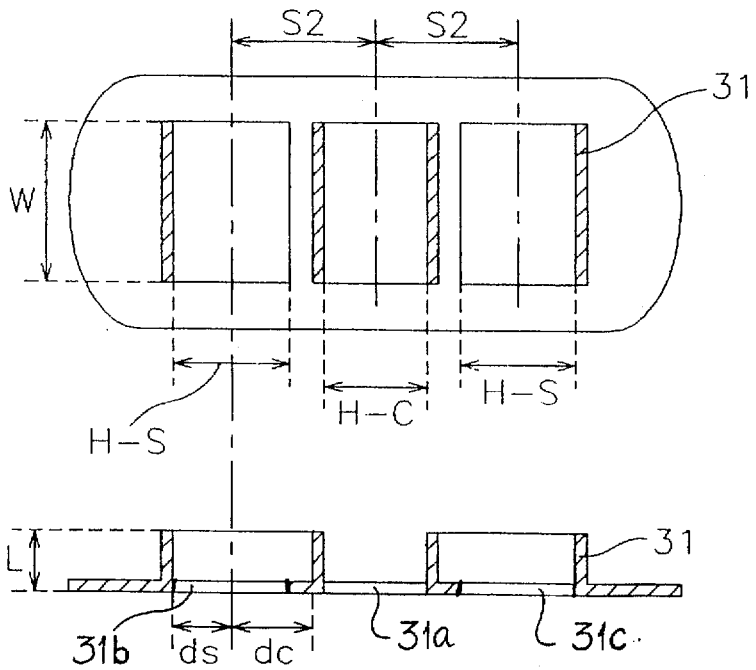
FIG. 5B
FIG. 6A
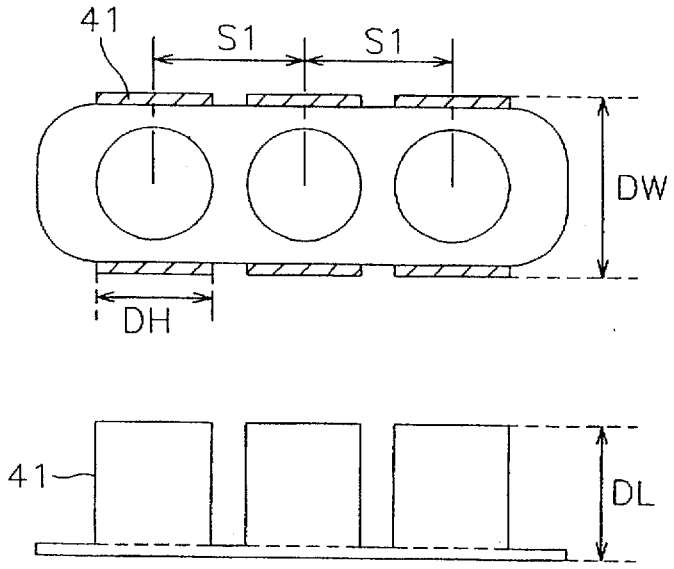
FIG. 6B

FIG. 7A
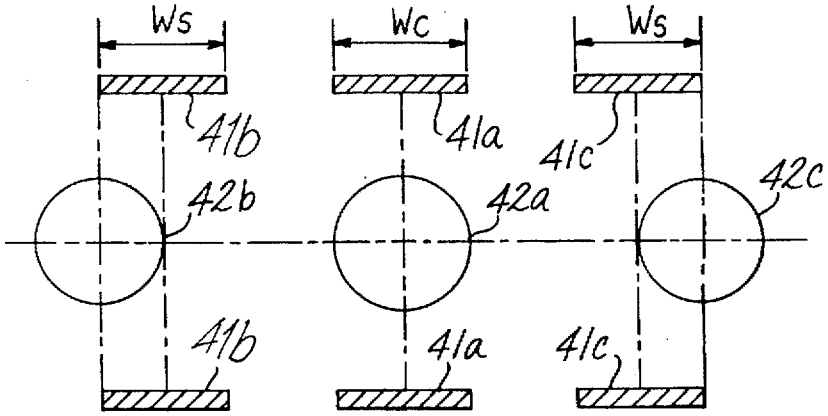
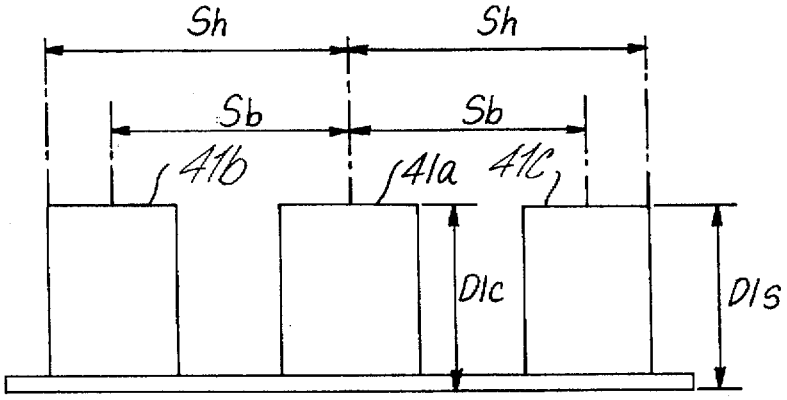
FIG. 7B

FOCUSING ELECTRODE STRUCTURE FOR A COLOR CATHODE RAY TUBE

CROSS REFERENCE

This is a continuation-in-part of patent application Ser. No. 08/319,457 filed Oct. 5, 1994, entitled "Electron Gun for Cathode Ray Tube," now abandoned.

FIELD OF THE INVENTION

The present invention relates to an electron gun for a color cathode ray tube and, more particularly, to an electron gun having a uniform static convergence characteristic throughout a screen, and at the same time easy to assemble, making an electron beam satisfactorily elongated even with low dynamic voltage, thereby improving the shape of focus of the electron beam.

DESCRIPTION OF THE PRIOR ART

A cathode ray tube includes an electron gun that generates an electron beam, a deflection yoke deflecting the above electron beam, a shadow mask to make the electron beam focus accurately, and a panel whereon fluorescent material is spread that emits light when the electron beam strikes, and is applied to all kinds of display devices such as a television picture tube or computer monitors and the like.

Generally, the resolution of the above cathode ray tube is greatly influenced by the size and the shape of the electron beam released from the electron gun, and unless the diameter of an electron beam is small and the shape of the electron beam is similar to a circle, high-quality resolution cannot be obtained.

In a conventional single focus type, as shown in FIG. 1, when an electron beam is deflected by a lopsided deflection magnetic field such as a pincushion magnetic field for horizontal deflection $D_H$ and a barrel magnetic field for vertical deflection $D_V$ for self-convergence, the size or the shape of the electron beam is distorted causing the picture quality to deteriorate, as shown in FIG. 2.

As shown in FIG. 1, the deflection power that deflects the electron beam horizontally focuses the electron beam vertically and forms spot 1 by pincushion magnetic field $D_H$, so that the electron beam is pressed vertically, and the deflection power that deflects the electron beam vertically radiates the electron beam horizontally and forms spot 2 by a barrel magnetic field $D_V$, so that the beam is extended horizontally. Accordingly, the electron beam receives both focusing power vertically and radiation power horizontally, and a halo as shown in FIG. 2 is generated on the screen causing the resolution of the picture to deteriorate.

To solve the above problem, the shape of the electron beam in the center of the screen of the color cathode ray tube is distorted intentionally, and therefore, the distortion of the relatively larger area of the screen, that is, peripheral parts of the screen is compensated. But this method causes the resolution in the center of color cathode tube screen to deteriorate.

In order to solve the above-described problem, a dynamic focus type, namely a double focus type, electron gun was developed and has been used, which is synchronized by the deflection electric current of the deflection yoke which varies the shape of electron beam simultaneously with varying the focusing distance of the electron beam.

This technique of the above-described dynamic focus type electron gun was described in Korean Patent Applications No. 90-6172 published on Aug. 24, 1990 and entitled "A Cathode Ray Tube", and No. 92-3357 published on Apr. 30, 1994 and entitled "An Electron Gun for Color Picture Tube".

The above-described cathode ray tube comprises a plurality of electron guns formed at the neck of a glass sealed body and a deflection coil mounted on the outside of a panel.

Each electron gun is formed of a group of cathodes, a group of accelerating electrodes, a group of front focusing electrodes, and a group of rear focusing electrodes arranged sequentially in the tube-axial direction.

The front focusing electrode comprises first and second lattice electrodes arranged sequentially in the tube-axial direction and having beam apertures to pass an electron beam. A predetermined focusing voltage is applied to the first lattice electrode, and dynamic focusing voltage which changes slowly according to the change of the deflection quantity of the electron beam, is applied to the second lattice electrode, and thereby focusing the electron beam lopsidedly toward the beam axis.

Additionally, the above-described electron gun for a color picture tube comprises a control electrode, an accelerating electrode, a focusing electrode and an anode arranged along the axis of the electron gun and arranged in the horizontal scanning direction. The focusing electrode is formed with the first focusing electrode near the above accelerating electrode and the second focusing electrode formed around the above anode.

The first focusing electrode includes three circular electron beam apertures according to the number of electron beams, and these electron beam apertures are supported by a plurality of parallel vertical flat electrodes, namely a vertical plate adhered to the second focusing electrode along the direction of the first focusing electrode. Additionally, these parallel flat electrodes are surrounded with rim electrodes, according to the number of contained horizontal electron beam or three circular electron beam apertures supported vertically in the direction of the arrangement of an electron beam, namely a vertical direction by a pair of or three pairs of parallel flat electrodes, namely, a horizontal level plate which is adhered to the second focusing electrode along the direction of the first focusing electrode, thereby both the electron beam apertures of each electrode secures the same distance from the axis of the electron gun, and therefore, an in-line type electron gun without displacement can be assembled.

However, the above-described conventional dynamic focus type electron gun is difficult to assemble, at the same time the electron beam can be made longer vertically only when the peak to peak of dynamic voltage reaches a predetermined voltage or more.

Another example of this technique is described in U.S. Pat. No. 5,300,855, by Kweon. Kweon discloses an electron gun assembly having a cathode, a control electrode, a screen electrode and a main lens system sequentially arranged in the axial direction of a color cathode ray tube. The main lens system is composed of a focus electrode, a dynamic focus electrode and a final accelerating electrode.

The electrodes of the main lens are supplied with predetermined voltages. A static focus voltage is applied to the focus electrode. The dynamic focus electrode is supplied with a dynamic focus voltage which is synchronized to the horizontal deflection current and has a negative peak voltage equal to the static focus voltage. The final accelerating electrode is supplied with an anode voltage which is the highest voltage.

With these predetermined voltages applied to their respective electrodes, a dynamic quadruple lens is formed between the focus electrode and the dynamic focus electrode and a major lens is formed between the dynamic focus electrode and the final accelerating electrode. Accordingly, as the horizontal scan approaches the periphery of the screen, the intensity of the dynamic quadruple lens increases causing the beam to focus in the horizontal direction and diverge in the vertical direction so that the cross sectional shape of the beams become vertically elongated. The vertically elongated beam is compensated for by the non-uniform magnetic field of the deflection coils forming a focused beam at the periphery of the screen. However, as the intensity of the dynamic quadruple lens increases, there is a corresponding decrease in intensity of the major lens due to the static anode voltage applied to the final accelerating electrode. As a result, the static convergence characteristic of the major lens is reduced when the beams are directed to the periphery of the screen.

SUMMARY OF THE INVENTION

Therefore, it is desired to reduce or eliminate the problems associated with conventional electron guns for color cathode ray tubes by providing a static convergence over the entire scan of the screen, which is easy to assemble, and at the same time makes an electron beam satisfactorily elongated with low dynamic voltage, thereby improving the shape of the focus of the electron beam.

A preferred embodiment of this invention provides an electron gun for a color cathode ray tube which comprises a control electrode, an accelerating electrode, an anode, and a focusing electrode which is divided into first and second focusing electrodes. A predetermined static focusing voltage, independent of a deflection period, is applied to the first focusing electrode located near the control electrode and accelerating electrode, a parabolic wave-form dynamic focusing voltage that varies according to the deflection period is applied to the second focusing electrode located near the anode. The first focusing electrode has three electron beam apertures. Around each electron beam aperture vertical parallel plates are mounted at the specified interval in the direction opposite the direction of electron beams. The distances from the center of the middle electron beam aperture to the center of each of the left and right electron beam apertures are longer than the distances between the centers of the vertical parallel plates.

In another embodiment of the present invention, a second focus electrode is provided with three apertures for passing a left, a central and a right electron beam therethrough. The second focus electrode has a pair of opposing horizontal plates along each aperture. The central axis' of the apertures for passing the left and right electron beams are offset relative to the central axis of the left and right pair of horizontal plates, respectively.

An attractive feature of one embodiment of the present invention is that a pre-static-convergence field is established to compensate for the decrease in intensity of the major lens by offsetting the electron beam apertures with respect to the vertical or horizontal plates. This novel focusing lens provides beam convergence and vertical elongation simultaneously and thereby preserves the high resolution imagery at the periphery of the screen. Moreover, by offsetting the electron beam apertures, the six vertical plates employed in Kweon can now be reduced to four resulting in a less expensive lens design.

BRIEF DESCRIPTION OF THE DRAWINGS

This invention can be more fully understood from the following detailed description when taken in conjunction with the accompanying drawings, wherein:

FIG. 5A is a cross-sectional front view and FIG. 5B is a cross-sectional top view of the first focusing electrode of the electron gun for the color cathode ray tube according to a preferred embodiment of the present invention;

FIG. 6A is a cross-sectional front view and FIG. 6B is a plan top view of the second focusing electrode of the electron gun for the color cathode ray tube according to a preferred embodiment of the present invention;

FIG. 7A is a cross-sectional front view and FIG. 7B is a plan top view of the second focusing electrode of the electron gun for the color cathode ray tube according to an alternative preferred embodiment of the present invention;

DETAILED DESCRIPTION

Figure 3:
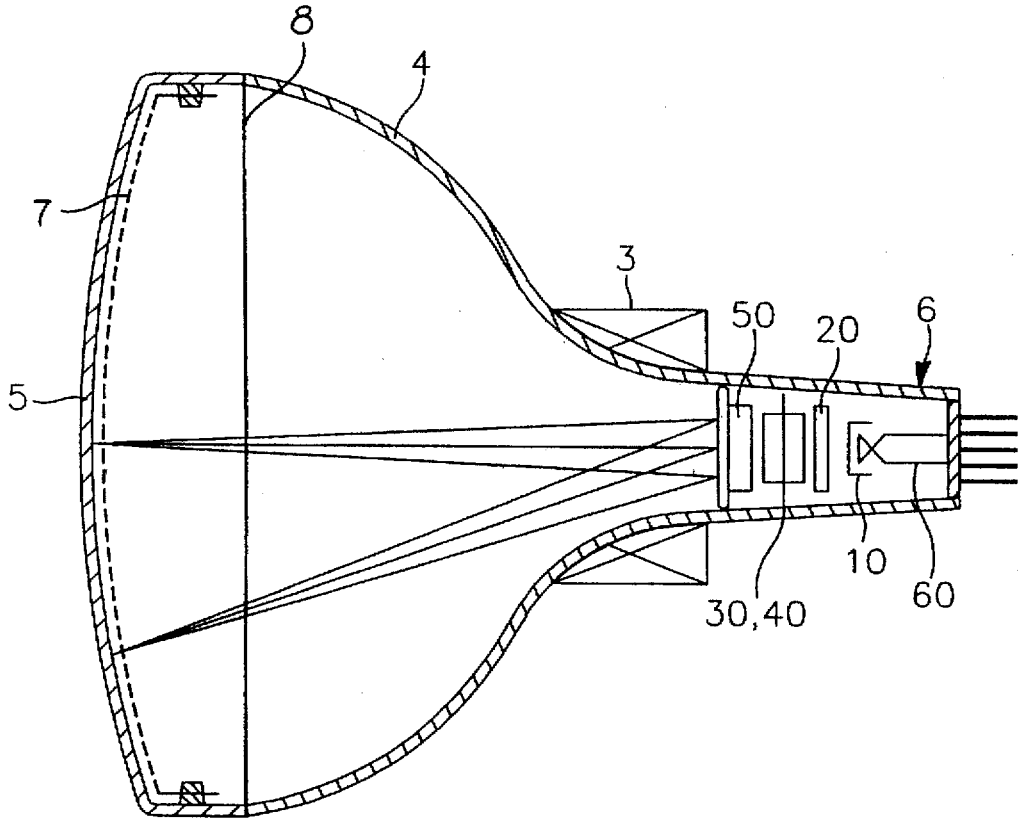
FIG. 3 shows a longitudinal cross-sectional view of an electron gun for the color cathode ray tube mounted on the rear end portion of the cathode ray tube according to a preferred embodiment of the present invention.

FIG. 3 shows an electron gun for a color cathode ray tube mounted on the rear end portion of a cathode ray tube according to a preferred embodiment of the present invention. The cathode ray tube comprises a panel 5 whereon fluorescent material is spread that emits light when an electron beam strikes it and a shadow mask 7 is mounted. A funnel 4 is combined with the panel 5 by a band 8 or the like, a deflection yoke 3 is mounted on the neck of the funnel 4, and an electron gun 6 is sealed up and mounted on the rear end portion of the funnel 4.

Figure 4:
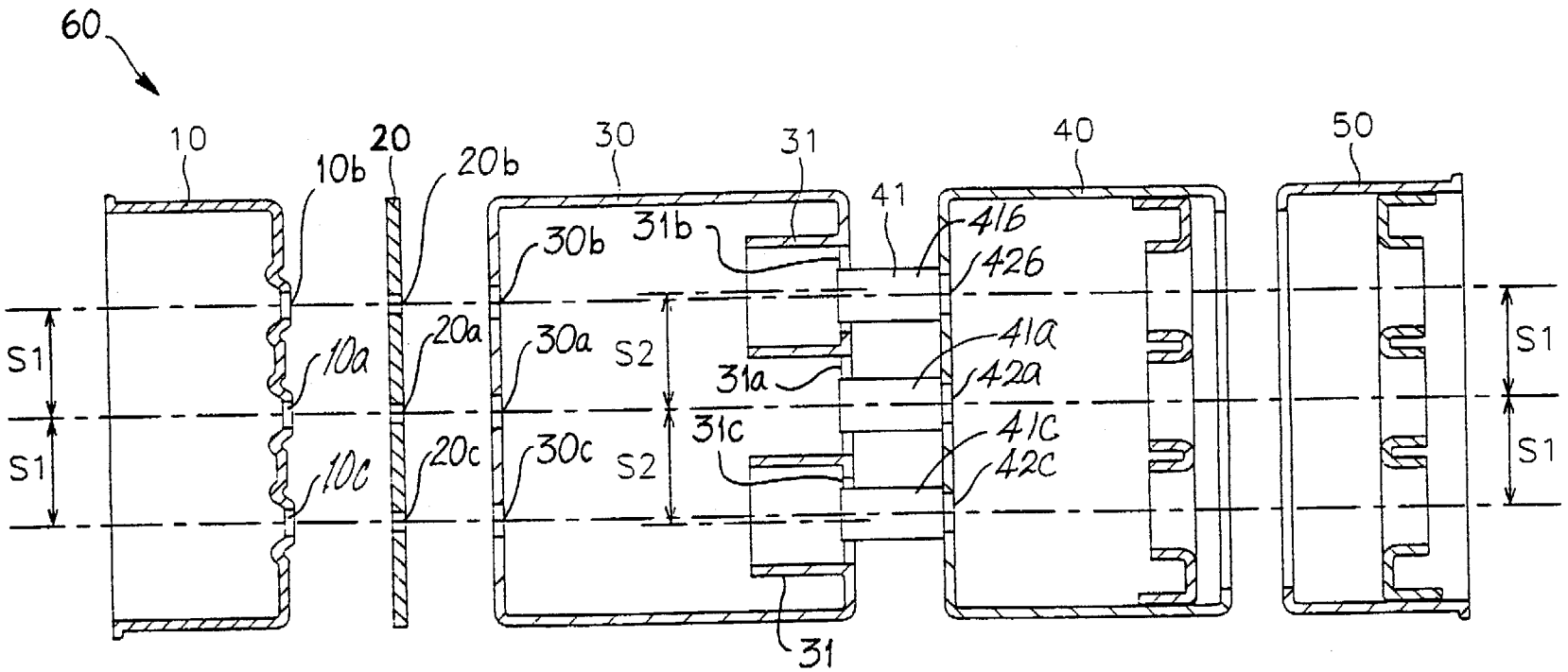
FIG. 4 is a longitudinal cross-sectional view of the electron gun for the color cathode ray tube of FIG. 3 according to the preferred embodiment of the present invention.

FIG. 4 shows a structure of the electron gun 6 for the color cathode ray tube according to the preferred embodiment of the present invention. The electron gun for the color cathode ray tube includes a control electrode 10 having three electron beam apertures 10*a*, 10*b*, 10*c* for passing the electron beams therethrough. An accelerating electrode 20 includes three electron beam apertures 20*a*, 20*b*, 20*c* for passing the electron beams which have passed through the control electrode 10. A first focusing electrode 30 includes vertical parallel plates 31 which are projected in the direction opposite to the direction of the electron beams. Three electron beam apertures, 31*a*, 31*b*, 31*c* are positioned at the back end of the first focus electrode 30 so that a central axis of the electron beam apertures 31*b* and 31*c* each have a distance S2 from a central axis of the electron beam aperture 31*a*. The distance S2 is longer than the distance S1 between the centers of the vertical plates 31. A second focusing electrode 40 is projected in the direction opposite the direction of the electron beams on upper and lower parts of respective three electron beam apertures, 42*a*, 42*b*, 42*c* and has horizontal parallel plates 41 which are introduced into the electron beam apertures 31*a*, 31*b*, 31*c* of the above first focusing electrode 30 so that the second focusing electrode 40 is not electrically connected with the above first focusing electrode 30. An anode 50 is positioned at the output of the second focusing electrode 40 and a thermoelectron emitting section 60, which is shown in FIG. 3, is positioned at the output of the anode 50.

FIG. 5A is a cross-sectional front view and FIG. 5B is a cross-sectional top view of the first focusing electrode of the electron gun for the color cathode ray tube according to a preferred embodiment of the present invention. The first focusing electrode 30 includes vertical parallel plates 31 the height of each which is W and the length of each which is L and which are mounted at equal intervals in the direction opposite the direction of the electron beams. Three square electron beam apertures 31*a*, 31*b*, 31*c* are formed between vertical parallel plates 31. The distances from the center of the middle electron beam aperture 31*a* to the centers of left and right electron beam apertures 31*b* and 31*c* are longer than the distance between the centers of vertical parallel plates 31 mounted at the same interval, so that the left and right electron beam apertures 31*b* and 31*c* are eccentric by a length equal to the difference between dc and ds against the vertical plates 31.

FIG. 6A is a cross-sectional front view and FIG. 6B is a plan top view of the second focusing electrode of the electron gun for the color cathode ray tube according to a preferred embodiment of the present invention. The inventive second focusing electrode 40 includes a horizontal parallel plate 41 whose width is DH and length is DL which is mounted on the upper and lower parts of three electron beam apertures in the direction opposite the direction of the electron beams. Circular electron beam apertures are formed respectively between horizontal parallel plates 41 of the upper and lower sides. The distance from the center of the middle electron beam aperture to both the centers of left and right electron beam apertures are S1.

In an alternative embodiment, enhanced convergence of the electron beams can be obtained by offsetting the electron beam apertures of the second focus electrode with respect to the horizontal plates and varying the lengths and widths of the horizontal plates with respect to one another as shown in FIGS. 7A and 7B. In this embodiment, the second focusing electrode 40 includes three pairs of horizontal plates 41*a*, 41*b*, 41*c* formed along the periphery of electron beam apertures 42*a*, 42*b*, 42*c*, respectively, and extending in the direction opposite the direction of the electron beams. The central horizontal plate pair 41*a* has a width WC and a length $D_{lc}$. The horizontal plate pairs 41*b*, 41*c* formed along the outside electron beam apertures 42*b*, 42*c* each have a width of $W_s$ and a length of $D_{1s}$. Preferably, the width $W_c$ and length $D_{lc}$ of the central horizontal plate pair 41*a* are greater than the widths $W_s$ and the lengths $D_{ls}$ of the horizontal plate pairs 41*b*, 41*c*. Preferably, the central horizontal plate pair 41*a* and the central electron beam aperture 42*a* are concentric and the central axis of the electron beam apertures 42*b*, 42*c* are eccentrically offset relative to the horizontal plate pairs 41*b*, 41*c*, respectively, by a length equal to the difference between $S_h$ and $S_b$. It will be appreciated by one of ordinary skill in the art that enhanced beam convergence can be achieved by offsetting either the electron beam apertures of the first focus electrode or second focus electrode individually.

Since the horizontal parallel plates 41 of the second focusing electrode 40 must be introduced into the electron beam aperture without electrical contact, the width $D_H$ and the height $D_W$ of the horizontal parallel plates 41 must be made smaller than the size of an electron beam aperture H-C, H-S of the first focusing electrode 30. Additionally, since the above-described horizontal parallel plates 41 of the second focusing electrode 40 must form an electrical field duplicated with the vertical parallel plates 31 of the first focusing electrode 30, the lengths of the horizontal parallel plates 41 of the second focusing electrode 40 are designed to have full length.

In the described embodiment of the present invention, the first focusing electrode 30 and vertical parallel plates 31 are used as a united member, but the technical range of the present invention is not limited hereto, and the vertical parallel plates 31 can be used, being made separately and welded to the other members.

Additionally, in the described embodiment of the present invention, the second focusing electrode 40 and horizontal parallel plates 41 are used as a separate member, but the technical range of the present invention is not limited hereto, and the second focusing electrode 40 may be formed to be integral with the horizontal parallel plates.

The operation of the electron gun for the color cathode ray tube according to a preferred embodiment of the present invention having the above-described structure is as follows.

A high-voltage power is applied to the electron gun 6 for a cathode ray tube causing the emission of thermoelectrons from a thermoelectron emission part 60 of the electron gun 6. The thermoelectrons are applied to the control electrode 10.

The control electrode 10 of the electron gun 6 controls the quantity of electron beams, and the brightness of the screen is controlled according to the size of voltage applied to the control electrode 10.

The electron beams which pass the aperture of the control electrode 10 of the electron gun 6 are applied to the accelerating electrode 20, the speed of the same is accelerated by the accelerating electrode 20, and then the beams are applied to the first focusing electrode 30.

Figure 9:
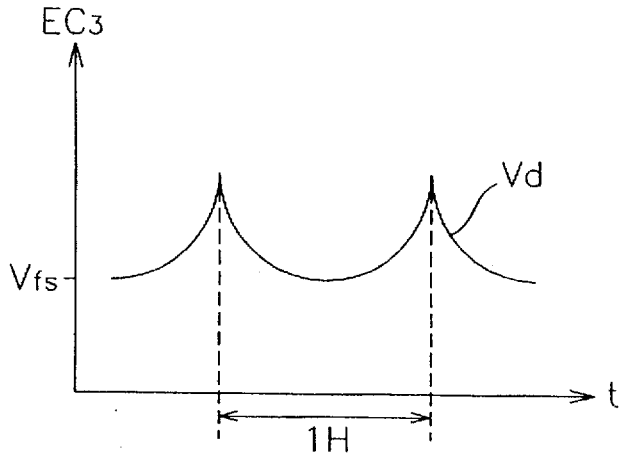
FIG. 9 is a drawing illustrating a voltage waveform applied to the first and second focusing electrodes of the electron gun for the color cathode ray tube according to the preferred embodiment of the present invention.

A static focus voltage $V_{fs}$, independent of the deflection period 1H of electron beams, as shown in FIG. 9, is applied to the first focusing electrode 30 and vertical parallel plates 31. To the second focusing electrode 40 and vertical parallel plates 41, a dynamic focus voltage $V_d$ is applied, which varies according to the deflection period 1H of electron beams, as shown in FIG. 9, whereby the first focusing lens 30 and the second focusing lens 40 forms a dynamic focus lens.

FIG. 9 is a figure of a voltage waveform that is applied to the first and second focusing electrodes of the electron gun for the color cathode ray tube according to a preferred embodiment of the present invention. The above-described dynamic focus voltage $V_d$ has a parabolic wave-form voltage which has a minimum value when there is no deflection power applied to electron beams, that is, in the middle of the screen, and as the deflection power applied to electron beams increases, the higher the voltage is.

Accordingly, between the first focusing electrode 30 to which static focus voltage $V_{fs}$ is applied and the second focusing electrode 40 to which dynamic focus voltage $V_d$ is applied, the dynamic focus lens is formed which is varied according to deflection period 1H.

Figure 8:
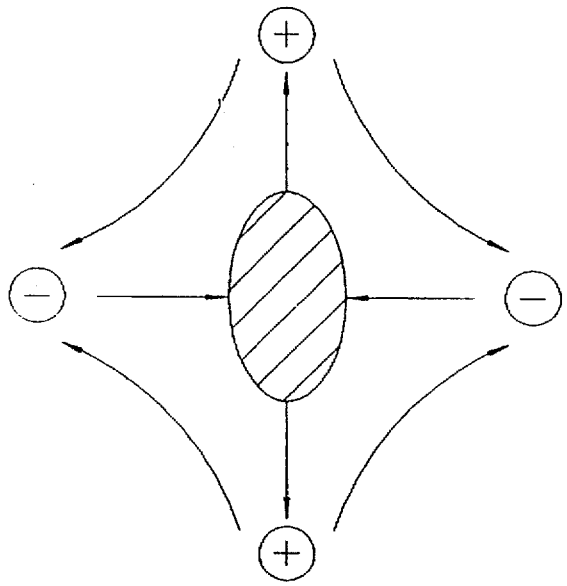
FIG. 8 is a schematic illustrating the vertical elongation of an electron beam emitted from the electron gun for the cathode ray tube.

If electron beams pass the aperture on the rear end portion of the first focusing electrode where the dynamic lens is formed as mentioned above, the electron beams become elongated vertically as shown in FIG. 8.

FIG. 8 shows that the electron beams emitted from the electron gun for the cathode ray tube are elongated vertically by focusing the electrode. Accordingly, in the middle of the screen when the size of the static focus voltage $V_{fs}$ is the same as that of the dynamic focus voltage $V_d$, the dynamic lens does not work and a circular electron beam is formed. The size of the static focus voltage $V_{fs}$, however, is different from that of the dynamic focus voltage $V_d$ in peripheral parts of the screen, so that the farther from the center of the screen the electron beam is, the more the electron beam is elongated vertically by the dynamic lens.

The vertical elongation of the electron beam, as shown in FIG. 8, becomes more obvious by the structure of the first and second focusing electrodes 30 and 40.

Therefore, according to one embodiment of the present invention, electron beams can be elongated vertically enough even with the dynamic focus voltage $V_d$ which is smaller than the voltage needed in the conventional art.

Accordingly, since the distances ds, dc from the centers of left and right apertures of the first focusing electrodes 30 to vertical parallel plates 31 mounted on both sides of the aperture are different from each other, and the left and right apertures of the second focus electrode 40 are offset from the horizontal parallel plates 41 by a distance equal to the difference between $S_h$ and $S_b$, the electron beams which pass through the left and right apertures are naturally converged to a center beam, thereby restoring the high resolution imagery that would otherwise be reduced by the weakened convergence effect at the main lens when higher dynamic voltages are applied to the second focusing electrode 40.

Figure 1:
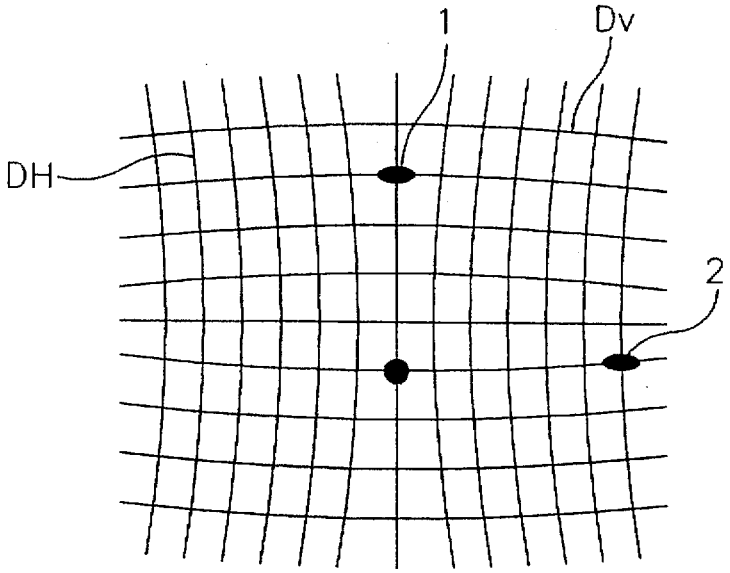
FIG. 1 (Prior Art)
FIG. 1 is a schematic illustrating the distortion of electron beams by a pincushion magnetic field for horizontal deflection and a barrel magnetic field for vertical deflection which are generated from a self-convergence type deflection yoke.
Figure 2:
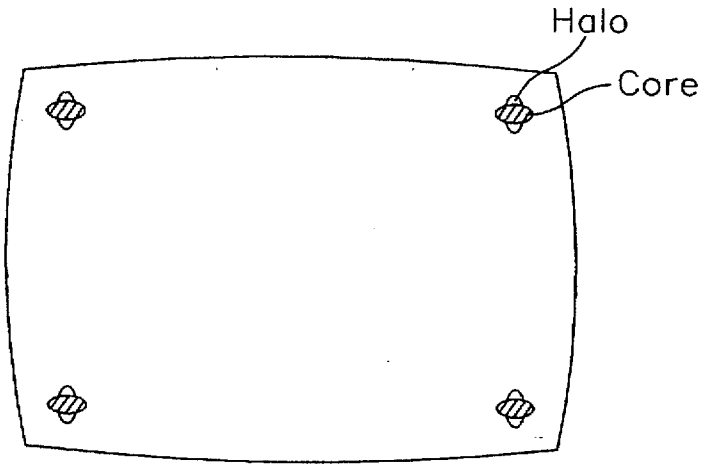
FIG. 2 (Prior Art)
FIG. 2 is a schematic illustrating the deteriorated picture quality of a peripheral part of a screen of a cathode ray tube caused by the distortion of electron beams.

The electron beam, which is elongated vertically with passing the first 30 and the second 40 focusing electrode, can improve the resolution throughout the screen by correcting the distortion of electron beams by a lopsided magnetic field generated from a self-convergence type deflection yoke, as shown in FIG. 1.

The above-preferred embodiment provides an electron gun for the color cathode ray tube which is easy to assemble, the electron beams are elongated vertically enough even with small valued dynamic voltage, whereby the shape of the focus of the electron beam can be improved.

The effect of the present invention can be used for design, manufacture and sale of the electron gun which is an essential element of the cathode ray tube.

What is claimed:

1. An electron gun for an in-line three beam color cathode ray tube comprising a first focus electrode having three apertures each for passing one of a left, a central and a right electron beam therethrough, said first focus electrode having a first and a second vertical plate formed along a perimeter of said left electron beam aperture and having a central axis therebetween parallel to said first and second vertical plates and offset from a central axis of said left electron beam aperture, and a third and a fourth vertical plate formed along a perimeter of said right electron beam aperture and having a central axis therebetween parallel to said third and fourth vertical plates and offset from a central axis of said right electron beam aperture, all said vertical plates extending parallel to each other in a direction opposite the direction of the electron beams.

2. The electron gun of claim 1 further comprising a second focus electrode having three apertures for passing said electron beams therethrough, said second focus electrode having a pair of horizontal parallel plates formed along a perimeter of each of said apertures extending in the direction opposite the direction of the electron beams, said parallel plates being positioned in said electron beam apertures of said first focus electrode.

3. The electron gun of claim 1 wherein the distance from the central electron beam to said central axis of said first and second vertical plates and to said central axis of said third and fourth vertical plates are less than the distance from the central electron beam to the central axis of said left and right electron beam apertures respectively.

4. The electron gun of claim 1 further comprising a control electrode having three apertures for passing said left, central and right electron beams to said first focus electrode, said left and right apertures of said control electrode each having a central axis whose distance from the central beam is less than the distance from the central beam to the central axis of said left and right electron beam apertures of said first focusing electrode.

5. The electron gun of claim 4 further comprising an accelerating electrode disposed between said control electrode and said first focus electrode and having three apertures for coupling said left, central and right electron beams therebetween, said left and right apertures of said accelerating electrode each having a central axis whose distance from the central beam is less than the distance from the central beam to the central axis of said left and right electron beam apertures of said first focusing electrodes.

6. The electron gun of claim 1 further comprising a second focus electrode having three apertures each for passing one of said left, central and right electron beam from said first focus electrode, said second focus electrode being formed with a first pair of horizontal plates, each having a first width formed along a portion of opposing perimeters of said left electron beam aperture so that a central axis perpendicular to the first width is offset from a central axis of said left electron beam aperture, and a second pair of horizontal plates, each having a second width formed along a portion of opposing perimeters of said right electron beam aperture so that a central axis perpendicular to the second width is offset from a central axis of said right electron beam aperture.

7. The electron gun of claim 6 wherein said first and second pairs of plates extend horizontally in a direction opposite the direction of the electron beams.

8. The electron gun of claim 7 wherein the distance from a central axis of said central electron beam aperture to the central axis of said first pair of plates is less than the distance from the central axis of said central electron beam aperture to the central axis of said left electron beam aperture, and the distance from the central axis of said central electron beam aperture to the central axis of said second pair of plates is less than the distance from the central axis of said central electron beam aperture to the central axis of said right electron is beam aperture.

9. The electron gun of claim 7 wherein said focus electrode further comprises a third pair of plates formed along a portion of opposing perimeters of said central electron beam aperture and extending horizontally in a direction opposite the direction of the electron beams, said horizontal extension of said third pair of plates being different from said horizontal extensions of said first and second pairs of plates.

10. The electron gun of claim 9 wherein the horizontal extension of said third pair of plates is greater than the horizontal extensions of said first and second pairs of plates.

11. The electron gun of claim 7 wherein said focus electrode further comprises a third pair of plates, each having a third width formed along a portion of opposing perimeters of said central electron beam aperture, said third width being different from said first and second widths.

12. The electron gun of claim 11 wherein said third width is greater than said first and second widths.

13. The electron gun of claim 1 wherein the second vertical plate is positioned between said left electron beam aperture and said central electron beam aperture, and the third vertical electrode is positioned between said right electron beam aperture and said central electron beam aperture, said second and third vertical electrodes forming an electric field through which said central beam passes.

* * * * *